United States Patent [19]

Grützner et al.

[11] Patent Number: 5,029,887

[45] Date of Patent: Jul. 9, 1991

[54] STEERABLE SKATEBOARD

[76] Inventors: Ute M. Grützner, Strohweg 55; Peter Mickenbecker, Heinestr. 41, both of D-6100 Darmstadt, Fed. Rep. of Germany

[21] Appl. No.: 471,217

[22] Filed: Jan. 26, 1990

[30] Foreign Application Priority Data

Jan. 28, 1989 [DE] Fed. Rep. of Germany ..... 3902547

[51] Int. Cl.[5] ..... B62M 1/04

[52] U.S. Cl. ..... 280/242.1; 280/47.371

[58] Field of Search ..... 280/242.1, 243, 266, 280/47.371, 87.041, 87.042, 47.34

[56] References Cited

U.S. PATENT DOCUMENTS 3,771,811 11/1973 Bueno ..... 280/87.042
4,202,559 5/1980 Piazza, Jr. ..... 280/87.042
4,319,760 3/1982 Romano ..... 280/243
4,776,604 10/1988 Valdez ..... 280/87.041
4,887,825 12/1989 Allen ..... 242/107 X

FOREIGN PATENT DOCUMENTS 3138095 4/1983 Fed. Rep. of Germany ..... 280/87.041
88/00550 1/1988 World Int. Prop. O. ..... 280/243

*Primary Examiner*—Charles A. Marmor
*Assistant Examiner*—Victor E. Johnson
*Attorney, Agent, or Firm*—Christensen, O'Connor, Johnson & Kindness

[57] ABSTRACT

A skateboard which can be propelled with both hands through manpowered propelling devices, and which has been designed in such a manner that a rider can both propel and steer from a body position favorable for high performance, is disclosed.

12 Claims, 3 Drawing Sheets

STEERABLE SKATEBOARD

TECHNICAL FIELD

This invention relates to skateboards and, more specifically, to a steerable skateboard.

BACKGROUND OF THE INVENTION

West German patent DE-GM 83 27 001 describes a steerable skateboard with a supporting platform; with one front and rear axle, each mounted at a right angle to the underside of the supporting platform; with the axles bearing a set of front wheels and rear wheels, respectively; and with a wheel hub firmly attached to the rear wheel set. The skateboard includes an acceleration device which consists of a spring and a traction rope. Except for a portion at the rear of the skateboard, the supporting platform is level. A small steering platform in the front of the supporting platform serves as steering device and, like the supporting platform itself, is positioned horizontally.

A disadvantage of the steerable skateboard of West German patent DE-GM 83 27 001 is that it leaves the skateboard rider with poor stability. In addition, only one guide roller for one traction rope is mounted at a location in front of the drive wheel. Consequently, one can only operate one traction rope with one hand, or hold onto it with both hands at the same time. This prevents riding in an optimal or comfortable position, both while operating the traction rope or otherwise. With the disclosed steerable skateboard, the rider has to bend slightly forward in order to use both hands, and must pull the rope upward in front of the stomach. This is generally very inefficient, in part because this position puts undue strain on the lower back.

The swivel axis of the foot support is also positioned inefficiently. The surface of the foot support and the front leg of the rider do not meet at a right angle, or along the rider's swivel axis. For this reason, in order to steer, the rider not only has to turn his leg, but also has to bend his foot along two axes if he wishes to keep his foot on the foot support while making a turn. Due to the limited flexibility of the ankle, a rider can only bend his foot in this way under a small range of circumstances. Riding a skateboard in this manner is inefficient, and is preceived as uncomfortable.

SUMMARY OF THE INVENTION

In accordance with this invention, a skateboard which can be propelled with both hands through man-powered propelling devices, and which has been designed in such a manner that a rider can both propel and steer from a body position favorable for high performance, is disclosed.

BRIEF DESCRIPTION OF THE DRAWINGS

The foregoing and other features and advantages of the present invention will become more readily appreciated as the same becomes better understood by reference to the following detailed description of the preferred embodiment of the invention when taken in conjunction with the accompanying drawings.

Figure 1:
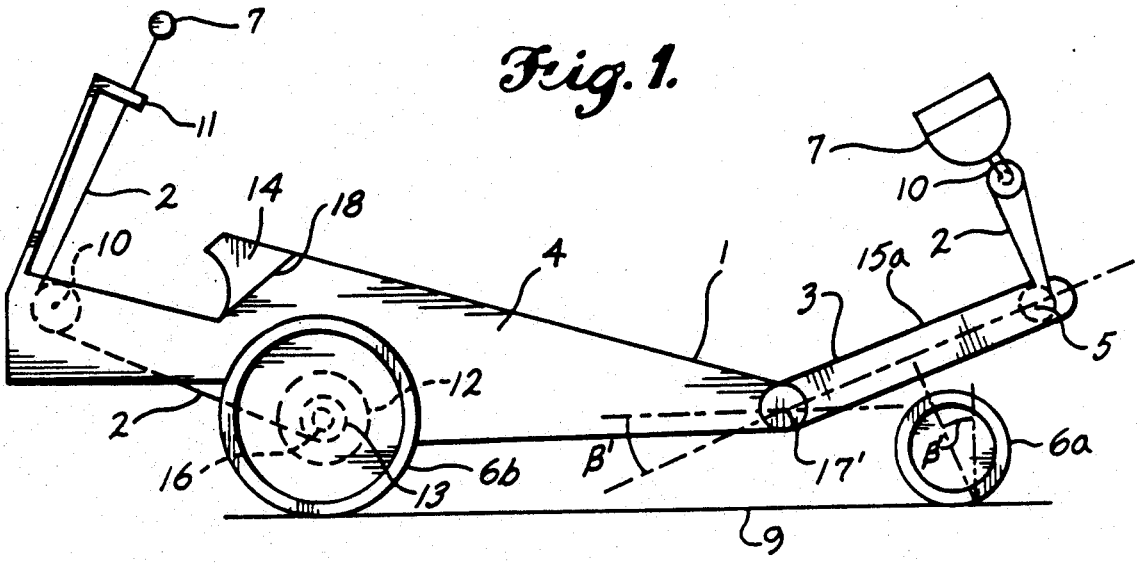
FIG. 1 shows a side view of a steerable skateboard made in accordance with the principles of the present invention.

For clarity, the following figure legend is provided:

1=frame unit
2=pull units
3=front portion of frame unit (1)
4=rear portion of frame unit (1)
5=roller connected to foot support (15)
6*a*=front wheels
6*b*=rear wheels
7=handles
7*a*=carrying handle
7*b*=handles on assisting devices (19*a*) and (19*b*)
8=collar unit
9=roadway surface
10=guide roller
11=length regulator
12=coaster hub or centrifugal clutch in wheel (6*b*)
13=coaster hub or centrifugal clutch on shaft (16)
14=hook-like steering guide
15*a*=front foot support
15*b*=rear foot support
16=drive shaft
17=hinge between foot support (15) and front wheel (6*a*), or front pulley reel (5). This hinge is used to adjust angle $\beta$. In the case of disengaging the adjustment, letting hinge (17) move freely, one can steer by way of the front pull unit (2) without rotating the front foot support (15).
17'=hinge between foot support (15), or collar unit (8) and rear portion (4) of frame unit (1). This hinge adjusts angle $\beta'$. Hinge (17') can also serve for folding collar unit (8) toward frame unit (1).
18=ledge
19*a*=assisting devices
19*b*=assisting devices
20=pull units on assisting devices (19*a*, 19*b*)
21=(snap) hook or the like
22=horizontal center axis of front foot support (15)
23=horizontal center axis of rear portion (4) of frame unit (1)

24 = pole
25 = swivel axis

DETAILED DESCRIPTION OF THE PREFERRED EMBODIMENTS

Figure 2:
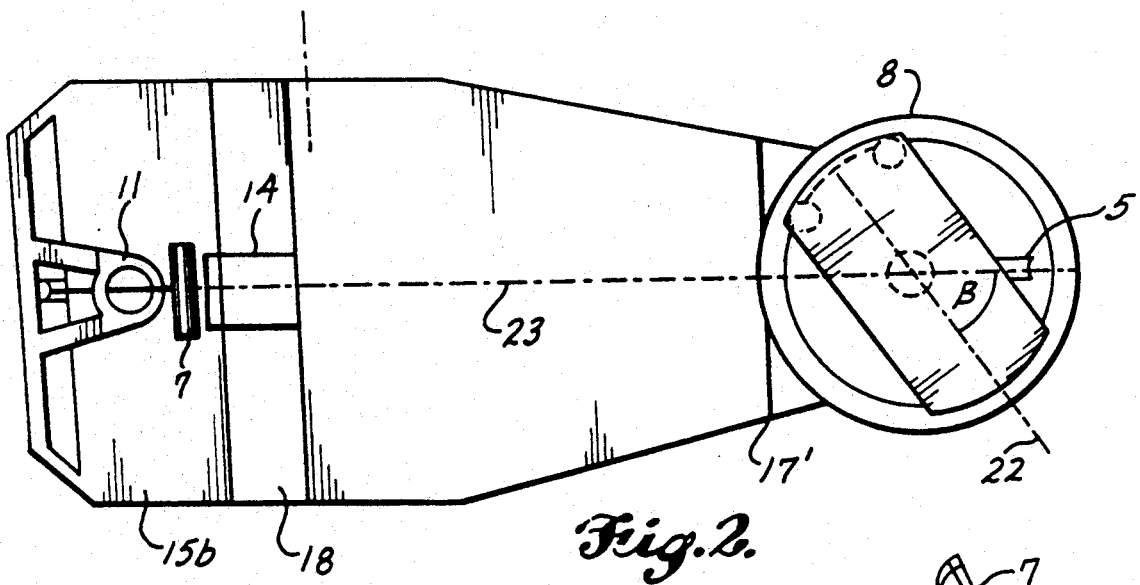
FIG. 2 shows a plan view of the skateboard.
Figure 3:
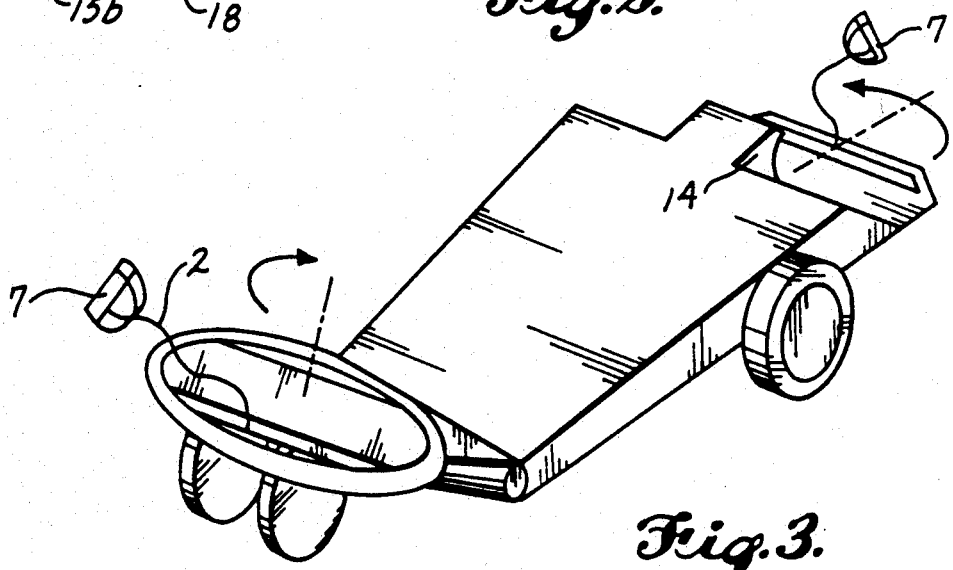
FIG. 3 shows a three-dimensional view of the skateboard from an oblique perspective.
Figure 4:
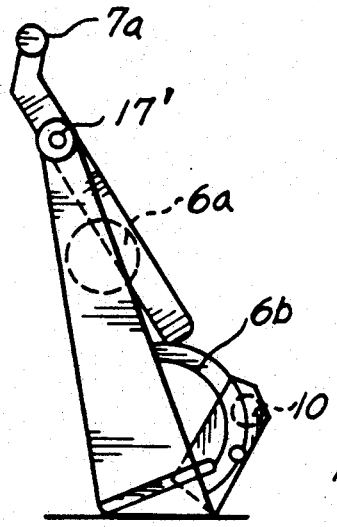
FIG. 4 shows a side view of the skateboard in a folded and upright position, with a carrying handle (7*a*) attached to the extension of the front portion (3). The front portion (3) has been folded against the rear portion (4) (now the lower portion). With the front wheel (6*a*) also folded in, the skateboard uses minimal space. The rear foot support (15) has been attached to the rear edge of the frame unit (10) in such a manner that dirt from the wheels (6) is caught inside.

Referring to FIGS. 1 and 2, the steerable skateboard includes a frame unit (1) divided into two parts, a front portion (3) and a rear portion (4).

The horizontal center axis (22) of a rotating front foot support (15*a*) and the horizontal center axis (23) of the rear portion (4) of the frame unit (1) form an angle ($\beta$) of 20° to 80°, preferably of 20° to 50°, as long as the steering assembly is positioned straight ahead. If the horizontal center axis (22) of the front foot support (15) is not discernible, it must be made obvious to the rider which direction the steering assembly is pointing.

The surface of the front foot support (15*a*), pointing toward the direction of propulsion, and the roadway surface (9) form an angle ($\beta'$) of 20° to 50°. Preferably, angle $\beta'$ is 20° to 40°, and most preferably it is 20° to 25°.

Angle $\beta$ can be adjusted at a hinge (17). This will be unnecessary if the front foot support (15*a*) is constructed as a disk. In this case, however, in order to assure sound handling of the skateboard, the neutral position of the front foot support (15*a*) must in some way be clearly indicated to the rider. The same is true in the case of a non disk-shaped foot support (15*a*) whose angle can be adjusted— in other words, whenever a rider does not "memorize" the angle and the steering position of the wheels is not immediately discernible.

A guide roller (5), shown in FIG. 2, fulfills this function, always pointing in the direction of propulsion. The guide roller for the front pull unit (2) is best attached to the front foot support (15*a*). In a design of particular advantage, the guide roller (5) is firmly connected to the front wheels, yet movable in relation to the surface of the front foot support (15*a*) along a hinge (17). This permits using the front foot support as a loading platform without it interfering with the steering movements.

Referring to FIG. 1, the skateboard is furnished with manpowered propelling devices, located both in the rear portion (3) and in the front portion (4). They have been designed as pull units (2), which can be operated by way of guide rollers (10, 5), and are fitted with handles (7). When not in use, the handles (7) may be held at a particular level above the frame unit (1) by length regulators (11). These length regulators may be attached to the skateboard and must not interfere with the pull units (2) when in use.

Operating the pull units (2) with the use of guide rollers (10, 5) has the effect similar to a gear shift, namely that equal force on the handles (7) effects doubling the force on the wheels (6). Analogously, operating the pull units (2) with the use of guide rollers (10, 5) effects doubling the speed of the skateboard while maintaining equal drawing speed.

Figure 1C:
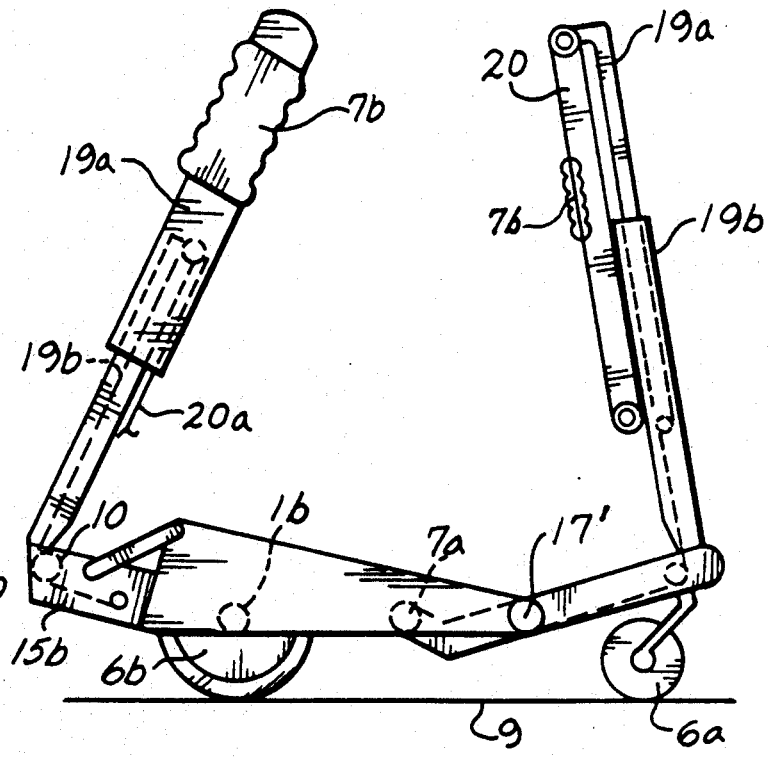
FIG. 1*c* shows a side view similar to FIG. 1, with the addition of assisting devices (19). It also depicts: a movable brace of the rear foot support (15); an extension of the front portion (3) of the skateboard, extending under the rear portion (4); and the preferably one-sided suspension of a preferably round, single front wheel (6*a*). The extension of the front portion (3) can serve to adjust the length of the skateboard.
Figure 5:
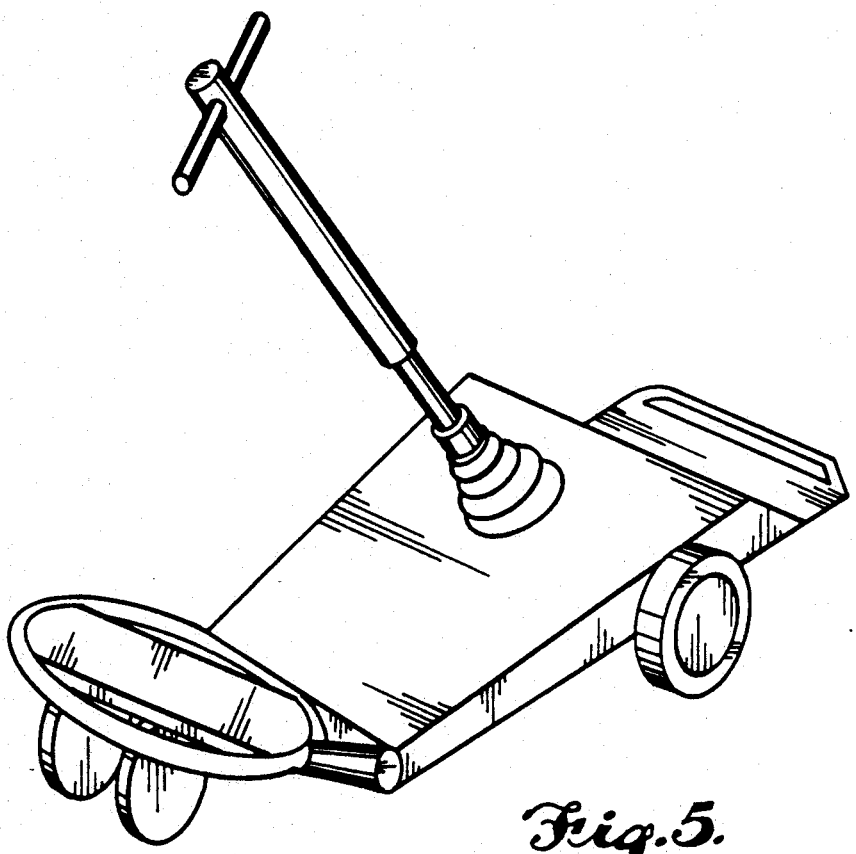
FIG. 5 shows a three-dimentional view of the skateboard with a pole (24) from an oblique perspective. The pole can be drawn up or pushed down on the handles (7).
Figure 1B:
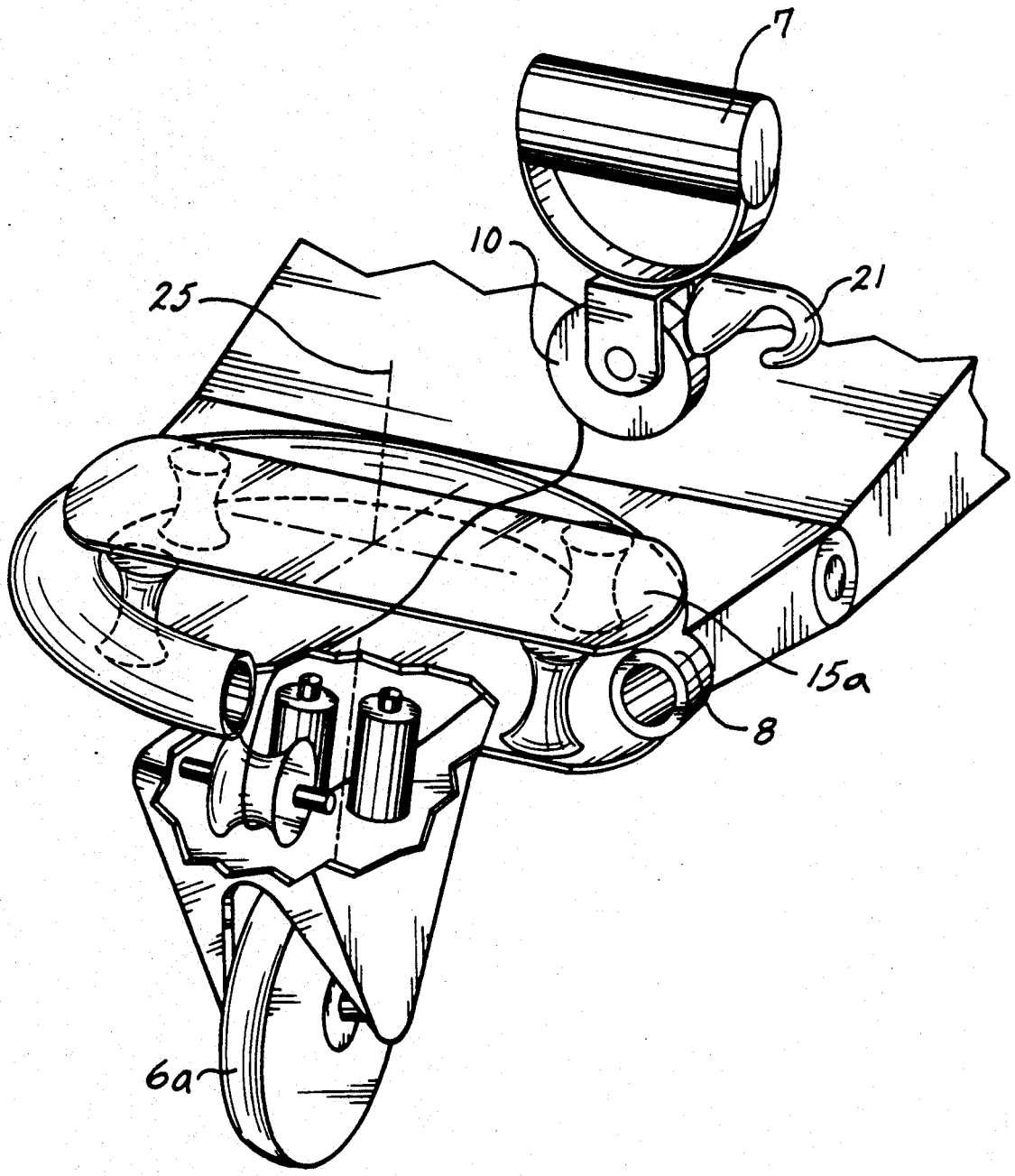
FIG. 1*b* shows the front portion of the steerable skateboard of FIG. 1, with a hook (21) attached to the pull unit (2) and fastened to the handle (7). During rotation of the front foot support (15*a*), the pull unit (2) is guided between two rollers located on the swivel axis (25) to prevent interaction between the rotating foot support and the pull unit.

As shown in FIG. 1*c*, one can provide for additional assisting devices (19*a*, 19*b*) which operate by pushing. The desired movement of the operator's arms approximately corresponds with those in cross-country skiing. The assisting devices (19*a*, 19*b*) may consist of an upper pole (19*a*) and a lower pole (19*b*), with a bearing that permits them to slide relative to each other. For clarity, the pole (19*b*) was drawn much thicker than would be true to scale. With a guide roller attached to the upper end of the upper pole (19*a*), the pull units (2) can be redirected onto the lower end of the lower pole (19*b*). This permits pushing a handle (7*b*) downward with an outstretched arm.

One can also provide for assisting devices (19*a*, 19*b*) which increase the movement of the hands relative to the length of the pull units (2). The right side of FIG. 1*c* shows such assiting devices by which the movement of the hands covers twice as much distance as the pull units (2). These assisting devices (19*a*, 19*b*) may consist of upper poles (19*a*) and lower poles (19*b*), with a bearing that permits them to slide along each other, and which have guiding rollers attached to their ends.

A second continuous pull unit (20) runs on the guide rollers of upper pole (19*a*) and lower pole (19*b*). Halfway between the two rollers, the handle (7*b*) may be mounted to one-half of the pull unit (20). Directly opposite, the pull unit (20) may be slidably attached to lower pole (19*b*). With such a design, the handle (7*b*) can be moved along a distance from about the lower end of the lower pole (19*b*) all the way to the upper end of the upper pole (19*a*). When extended, only a short piece of the upper pole (19*a*) is in contact with the lower pole (19*b*).

This design creates assisting devices, or poles (19*a*) and (19*b*), which can slide relative to each other, taking up very little space, yet which allow great movements of the arms or hands. In the design illustrated in FIG. 1*c*, the movement of the hands covers twice the distance relative to the distance covered by the pull unit (20). This gearing has the opposite effect of the guide roller (10). Any other ratio of gearing can also be employed.

All modifications of the propulsion mechanism can be combined with each other in any manner. For instance, the pushing feature can be combined with lengthening the distance covered by the pull units (2). Or another pull unit (2) can be attached to the lower end of an upper pole (19*a*), to be operated by pushing. When the handle (7*b*) is drawn upward in reverse motion, this pull unit (2) is activated again for propulsion. In this case, the shaft (16) would need another coaster hub (13). It is also possible to use only an assisting device for propulsion, for instance at the rear guide roller (5), preferably in the area between the center between the two axles (17', 16) and the front edge of the rear foot support (15*b*).

The pull units (2) can be blocked at any desired length from the frame unit (1), such that they neither retract automatically when the weight of the load lightens, nor are drawn out any further when the weight of the load increases. They can also be disengaged from the drive shaft (16) through the centrifugal clutch or the coaster hub (13). This will prevent the driving wheels (6*b*) from retracting the pull units (2) when they roll in reverse, or it will permit the pull units (2) to be drawn out without driving the wheels (6*b*).

Of any two or more manpowered propelling devices operating the drive shaft (16), each can be fitted with at least one centrifugal clutch and/or at least one coaster hub (13).

The drive wheels (6*b*) can each be connected to the drive shaft (16) with one coaster hub and/or one centrifugal clutch. The steering axis of the steerable front wheels (6*a*) and the roadway surface may constitute an angle of less than 90°, and/or the angle of the steering axis can be adjusted to be less than 90°, as well as fixed at 90°.

The rotating foot support (15) may have a bearing of rollers (6) which roll along the collar unit (8). At least one foot support (15) may be connected with the frame unit (1) in a movable manner, and may be fixed with an adjustment device. Thus, dirt from wheels (6) or from underneath the skateboard is at lest partly enclosed, and/or the dimensions or storing properties of the skateboard can be changed.

The incline of the front foot support (15) relative to the roadway surface (9) can be adjusted and fixed as desired.

At least one steering guide (14) is provided under which one can place one's foot, and which permits the lifting of the skateboard.

A collar unit (8) encloses the rotating front foot support (15*a*) and serves as a bearing for the foot support, i.e., it constitutes part of the bearing. Rollers (5) mounted to the foot support (15*a*) with bearings roll along the collar unit. The collar (8) is firmly connected with the front portion (3) of the frame unit (1).

Using two pull units at the front and rear portion of the skateboard for acceleration results in an ideal arrangement of the foot support at the front and rear portions of the skateboard. The feet should be placed as closely as possible to the guide rollers. That way, the forces weighing on the skateboard remain rather small, and the rider can use his arms most efficiently. This position also gives the user the greatest strength and enables him to work arms, body and legs along one line.

Since the front portion with the rotating foot support can be folded along a hinge relative to the rear portion, the angle between these two portions can be adjusted and fixed. This permits the rider of the skateboard, who stands at a right angle relative to the direction of movement, to have both feet firmly planted on a foot support of the skateboard. With legs spread comfortably apart, the front leg or foot stands securely on the rotating foot support which is intended for steering.

By using pull and push forces for locomotion in accordance with the invention, the rider exercises diverse muscle parts. This approximately equal exertion results in higher performance because it is muscle parts complementing each other (antagonists) which are exercised and trained. This results in a medically desirable, even development of the muscles. It is efficient and physiologically advantageous, and prevents defects resulting from tension and incorrect posture.

The intended lengthening of the radius of manipulation translates into speed. The rider can swing out further, or can choose more freely the radius in which to swing the handles back and forth. In this way, more extensive muscle parts of the body can participate in the workout. Uniform motion also leaves the rider more time to channel his physical exertion, or to relax.

As provided by this invention, one can use both arms in any manner, and each independently of the other. For longer distances, for instance, one might more likely pull alternately, whereas one may wish to pull simultaneously with both arms for jumping a curb. The greatest riding comfort is achieved when the assisting devices can make use of both pull and push action. In such case, for instance, with each pull unit corresponding to one coaster hub, a total of four coaster hubs would turn the drive shaft.

By using one coaster hub in each of two wheels on the same drive shaft, one can safely lift any wheel or ride on a slippery surface. As long as one wheel is still gripping, the other will not spin.

Propelling the skateboard through pull units permits a controlled, steady ride, even at lowest speeds. In contrast to the more familiar skateboard, one need not touch the ground with one's feet even at low speeds. This comes in handy, for instance, when one wishes to keep shoes clean and dry on muddy ground. The option to propel oneself slowly, without having to have acrobatic skills, even on rough ground, is an important advantage of the invention presented herein.

As provided in this invention, the design with a rotating foot support allows very simple, yet rugged mounting of the wheels of the shaft on which they turn. The guiding and winding mechanisms of the pull units can be implemented equally easily. It is of particular advantage to this design to extend the edges of the supporting platform downward on the sides and in the very back, creating a case-like frame, closed on two sides and the back, and the top used as platform. The sides of this frame are especially suited for bearing the rear wheel drive shaft. This kind of frame is lightweight, yet stiff, protecting the mechanisms mounted on it, and it forms a fender. When the whole board is folded together and stored in an upright position, the frame prevents dirt from touching the surroundings.

For a skateboard in riding position, the collar unit makes a particularly convenient carrying handle. Since the collar unit encloses the foot support and can be padded on the outside, it functions as a protective bumper. The collar unit assures the rider trouble-free steering. Without the collar unit, any slight collision more likely distorts the steering because the rotating foot support, which extends beyond the frame unit, already stands almost at a right angle even when the board moves straight ahead. The steering mechanism as provided by this invention enables a person without experience to immediately ride the skateboard at moderate speeds.

The combination provided by this invention, namely a rotating foot support combined with pull units at the front and rear portion of the skateboard, has great advantages. This is especially true in regard to transporting loads, and children or animals in particular. The pull unit at the front portion offers itself for actually pulling the board, similar to pulling a loaded hand wagon.

The invention also provides for a complete blocking of the pull unit of the skateboard. For instance, a child can pull a playmate sitting on the skateboard in the same manner as pulling a sled. Much in contrast to more familiar skateboards, the design of the front pull unit as provided in this invention permits outstanding maneuverability even in very tight turns.

When pulling the board in the manner of a hand wagon, assistance by a person sitting on the board is not required for steering. Thus a skateboard as provided by this invention allows maneuvering tight turns while pulling the board behind oneself. Among other things, this may come in handy for shopping when transporting goods from the store to the car. Since the board does not need to be returned to the store, it is more convenient than using a shopping cart. Besides, it allows the user to quickly reach a store from the car, for instance, and in big stores is more convenient than a cart, due to its increased maneuverability. The invention also provides for some kind of lock (e.g., a type of "Tanka" lock) to block the length of the pull unit at a comfortable height. After use, the pull unit will automatically retract.

Since the pull unit can be blocked at a desired length, for instance by means of a foot pedal or a notch on the guide roller connected to the handle, one can keep the skateboard under control even during a jump. In the case of traditional skateboards, the rider has to hold onto the board with his hands when jumping certain formations.

Due to the advantageous design of the guide rollers at the front and rear portion of the skateboard, the propelling device as provided in this invention allows a much safer use than would be possible with traditional skateboards. Having something "to hold onto" is especially important to beginners, who may too easily be scared away otherwise. By pulling on the pull units, as long as the board touches the ground, one can pull the skateboard as provided by the invention toward one's feet. Similarly, one can enhance one's balance on the board by pulling on the handles.

The only disadvantage would be that pulling on the handle would cause it to slacken, somewhat faster or slower depending on the gear and speed. Thus, one cannot hold onto the handles for a long time in order to become more steady. This disadvantage is also overcome by the blocking of the pull devices, as provided by the invention. Standing in the middle between the pull units, and supporting the feet approximately at the location where the pull units merge with the frame, one can optimally brace oneself against the board. This is of particular interest when coasting downhill, at which time one does not need more speed, but rather, more secure footing, especially for jumping. When the block is released and the pull slackens, the pull units automatically retract into the skateboard. This ensures that the pull units adjust to the optimal length for each individual rider and in each unique situation.

Devices with coaster hub and pull units typically have the disadvantage that rolling in reverse causes the pull unit to retract, or that rolling in reverse is altogether impossible. "Disengaging" the coaster hub would avoid this disadvantage. In a sense, it attempts the exact opposite of the above-mentioned blocking. Having this option is very useful, for instance when a skateboard with a heavy load is to be moved from a standing position, or when a skateboard with a load must be maneuvered in a small space.

In addition, turning around in minimal space by standing on the skateboard, lifting the front wheels and swinging around at the same time, requires disengagement of the centrifugal clutch. Especially those who skillfully ride a traditional skateboard will make frequent use of this technique. If the propelling device could not be disengaged, it would be impossible to rotate on one spot and around one's own axis. The best one could do, short of pulling the handles toward the board, would be to rotate around one wheel. A turn like that requires more space, more energy, and more time.

In practice, the coaster hub can, for instance, be disengaged, by a lever to step on. It could be fitted with a profile on the inside, and shifted along a shaft with matching profile, the shaft being round along a portion of its length.

The angle $\beta$ between the two portions of the support platform gives the skateboard rider a firm support for his feet. The rider stands with his legs spread comfortably apart and travels at a right angle relative to the direction of movement. The front leg, or foot, stands firmly, pointing slightly diagonally forward on the rotating foot support, which is intended for steering. In accordance with the invention it is possible to adjust the angle of the foot support relative to the road surface.

When a skateboard is propelled in the said manner, and if it is to be used by different riders to their satisfaction, then the angle of the rotating front foot support should be adjustable. This has been confirmed by test runs. People of different frame, whose leg length greatly varies, can get by without adjusting the length between the front and rear foot support, provided the angle between those corresponds to the angle by which various riders comfortably spread their legs.

It is a purpose of the invention to improve the ease of operation of skateboards. This can be done in two ways with the help of an adjustable front foot support.

Transporting loads of greater size on the skateboard would be inconvenient with the inclining front foot support and the sloping surface of the frame unit, both of which meet at an angle. If the angle can be adjusted in such a manner that both surfaces form one plane, then one could create an almost horizontal loading surface.

In this context the adjustment options for angles $\beta$ and $\beta'$ can complement each other. By adjusting angle $\beta'$, the front foot support can be positioned horizontally, and this surface can be used as an extension of the frame. However, when a large item is placed both on the frame unit and the foot support, then it could be quite annoying to have the foot support turn with each steering movement. This is easily remedied. When the adjustment device on the hinge of angle $\beta$ is not in a fixed position, but disengaged, then foot support (15*a*) can move freely relative to the front wheel and guiding roller. Even when a heavy load partly lies on the collar unit (e.g., a sack of potatoes) and would normally obstruct steering movements of the pull unit in its ordinary position, pull unit 2 still allows easy steering. FIG. 2 shows how the pull unit can simply be drawn out from under the collar unit.

For space-saving storage when the skateboard is not needed, the invention provides for folding the front foot support downward. The front wheels are bent toward the underside of the frame. That way when the board is transported by car, for instance, the wheels cannot touch and soil the trunk.

As provided by the invention, the bearing for the rotating, front foot support is not mounted between wheels and foot support; rather, it is mounted in the form of a collar around the foot support.

FIG. 2 shows a solution which keeps production costs down: a roller is mounted under each corner of the foot support, which is flush to and rolls along the collar. These rollers can simply contain a ball bearing, and they are mounted so far on the outside that they can brace effectively against the collar unit. The collar unit need not be finished as precisely as other bearings of the same size would have to be. The rollers can even have a surface of synthetic material. Being connected to the skateboard along its edges, the foot support of this design experiences much less strain than the traditional design with support in the middle. Consequently, the foot support can be thinner and more lightweight, yet it will be much stronger. It can also be reinforced along the primary stress points, for instance, by extending the edges downward; this does not significantly interfere with mechanics or space underneath the collar unit. As such, the foot supports can be made of thin tin-plate construction which, for production reasons, would be impossible with a traditional design.

Combined with the fact that the frame of the skateboard does not extend between wheels and foot support, but rather, it encloses the foot support with a collar, this design permits use of much bigger wheels than those used in familiar constructions. The wheels can easily yet ruggedly be mounted directly to the foot support.

The surface of the foot support as provided by the invention can lie particularly low, or, as there is much space available, the wheels can be fitted with springs. For this purpose, a rubber bearing swivel axle (known from traditional skateboards without a rotating platform) can simply be bolted directly under the foot support.

For a skateboard in riding position, the collar unit makes a particularly convenient carrying handle. Since the collar unit encloses the foot support and can be padded on the outside, it functions as a protective bumper. The collar unit assures the rider trouble-free steering. Without the collar unit, any slight collision more likely distorts the steering because the rotating foot support, which extends beyond the frame unit, already stands almost at a right angle even when the board moves straight ahead. The collar unit is always within the field of vision and constitutes a notable characteristic of the skateboard as provided by the invention.

Uniting form and function, the collar unit symbolizes the function of the foot support: namely, that of a steering wheel. The combination of foot support and collar results in a form which has a striking similarity to the steering wheel of a car. Since a significant portion of the target group does not consist of die-hard skateboarders, this psychological element is of importance. The design intends not to suggest resemblances to a traditional skateboard. To the contrary, this steering device emphasizes the reliability, ease and familiarity of handling the board. An untrained rider always fears missing a step or sliding off the narrow platform of a traditional skateboard. This, and the fear of embarrassment at the first clumsy tries, are alleviated through the design presented. The collar has a reassuring effect, as though it were a life preserver or a railing protecting one from a fall. Thus the collar contributes in its own way to the confidence on the part of users regarding the controllability and safety of the device.

In addition, the collar indicates the position for the front foot, marked by its center (crossed lines). It does not force the user into one precise position, however, but leaves freedom for individual accommodation.

The collar also comes in handy for securing the skateboard against theft with a chain and padlock, for instance on a bike rack. Only one steerable front wheel is required for a skateboard as provided by the invention. However, one can also mount two wheels. In order to attain favorable steering dynamics when only one front wheel is used, it is advisable to use a profile touching the ground at only one point, or which at least has rounded edges, rather than a profile with a flat tread.

The manpowered propelling devices each operate the drive shaft by way of a coaster hub or the like. If both propelling devices operate the same drive shaft, it has been proven functional to connect the two winding mechanisms for the pull units of the propelling devices through a balancing unit. This balancing unit ensures that the pull unit currently not used for propulsion is wound up in a direction opposite to the direction of propulsion. The balancing unit can be fitted with a spring, which pulls the balancing unit away from the winding mechanism. This helps the pull units to wind up neatly onto the winding mechanism.

As provided by the invention, a skateboard has been designed with improved propulsion, performance, and ease of operation, which is simple to manufacture, which is easy to steer, and which provides the rider of the skateboard with improved steadiness.

Ease of operation primarily means how practically useful the skateboard can be to the broadest possible section of the population in handling diverse tasks in everyday life. Physical exercise is not the main objective, but a beneficial side effect.

The embodiments of the invention in which an exclusive property or privilege is claimed are defined as follows:

1. A skateboard, comprising:

a frame unit having front and rear portions, said front and rear portions each having a horizontal center axis;

wheels rotatably mounted to each of said front and rear portions of said frame unit;

plural propelling means coupled to said wheels for converting pushing and pulling forces conveyed by a body part of a rider of said skateboard into a rotating motion of said wheels, thereby propelling said skateboard in a forward or rearward direction; and a telescoping pole comprising upper and lower portions capable of sliding lengtwise relative to each other in both a first axial sliding and a second axial sliding motion, the lower portion being swivelably mounted on said frame unit and engaged with said plural propelling means so as to convert said first and second axial sliding motions between said upper and lower portions into a propelling motion of said skateboard.

2. A skateboard according to claim 1, wherein at least one of the front and rear portions of said skateboard is attached to a pair of wheels connected by way of a drive shaft.

3. A skateboard according to claim 1, wherein said lower portion of said telescoping pole can swivel in any direction relative to said frame unit.

4. A skateboard according to claim 1, which has two sets of upper and lower telescoping poles, which comprise upper and lower portions, swivelably mounted on the front and rear portions of said frame unit, respectively, each of said poles being engaged with a propelling means.

5. A skateboard according to claim 1, which has one telescoping pole mounted swivelably on the horizontal axis of said rear portion of said frame unit, and centered between a pair of wheels attached to said rear portion of said frame unit.

6. A skateboard according to claim 1, wherein said front and rear portions of said frame unit are connected so that said horizontal center axis of said front portion forms an angle $\beta'$ of from 20–50 degrees with a surface of a roadway under said skateboard.

7. A skateboard according to claim 6, further comprising:

at least one hinge connecting said front and rear portions of the frame unit, which permits folding the front portion towards the rear portion of said frame unit and adjustment of said angle $\beta'$.

8. A skateboard according to claim 2, wherein said propelling means operate one said drive shaft.

9. A skateboard according to claim 1, which further comprises:

at least one steering guide attached to said frame unit under which a rider can place a foot to permit lifting of the skateboard.

10. A skateboard according to claim 1, wherein said front portion of said frame unit can swivel relative to said rear portion of said frame unit thereby enabling steering of said skateboard by a foot of a rider of said skateboard.

11. A skateboard according to claim 1, further comprising a handle attached to said upper portion of said telescoping pole.

12. A skateboard according to claim 1, which further comprises at least one centrifugal clutch connecting said propelling means to at least one of said wheels.

* * * * *

UNITED STATES PATENT AND TRADEMARK OFFICE

CERTIFICATE OF CORRECTION

PATENT NO. : 5,029,887

DATED : July 9, 1991

INVENTOR(S) : U.M. Grutzner et al.

It is certified that error appears in the above-identified patent and that said Letters Patent is hereby corrected as shown below:

| COLUMN | LINE | |
|---|---|---|
| 1 | 46 | "preceived" should be --perceived-- |
| 5 | 3 | "lest" should be --least-- |
| 9 | 29 | "not" should be --not-- |
| 10 | 24 | "lengtwise" should be --lengthwise-- |

Signed and Sealed this

Ninth Day of February, 1993

*Attest:*

STEPHEN G. KUNIN

*Attesting Officer*

*Acting Commissioner of Patents and Trademarks*